US010738558B1

(12) United States Patent
Orbell

(10) Patent No.: US 10,738,558 B1
(45) Date of Patent: Aug. 11, 2020

(54) MODULAR ROTATING DIVERTER HEAD

(71) Applicant: ADS Services LLC, Midland, TX (US)

(72) Inventor: Charles Robert Orbell, Satellite Beach, FL (US)

(73) Assignee: ADS Services LLC, Midland, TX (US)

( * ) Notice: Subject to any disclaimer, the term of this patent is extended or adjusted under 35 U.S.C. 154(b) by 164 days.

(21) Appl. No.: 15/836,332

(22) Filed: Dec. 8, 2017

(51) Int. Cl.
*E21B 33/08* (2006.01)

(52) U.S. Cl.
CPC ..... *E21B 33/085* (2013.01)

(58) Field of Classification Search
CPC ..... E21B 33/085
See application file for complete search history.

(56) References Cited

U.S. PATENT DOCUMENTS

| | | | | |
|---|---|---|---|---|
| 4,281,724 | A * | 8/1981 | Garrett | E21B 33/085 166/84.3 |
| 4,285,406 | A * | 8/1981 | Garrett | E21B 33/085 175/195 |
| 4,363,357 | A * | 12/1982 | Hunter | E21B 33/085 166/84.3 |
| 7,308,954 | B2 | 12/2007 | Martin-Marshall | |
| 8,286,734 | B2 | 10/2012 | Hannegan et al. | |
| 2009/0101333 | A1* | 4/2009 | Williams | E21B 33/085 166/84.1 |
| 2018/0334862 | A1* | 11/2018 | Chambers | E21B 33/085 |

* cited by examiner

*Primary Examiner* — D. Andrews

(57) ABSTRACT

A modular rotating diverter head is disclosed for use on oil, gas or geothermal wells. While providing for sealing with or without rotation of the drill pipe, the head consists of a central housing body which has removable mounted flanges for vertical and horizontal use. The design enables the use of a multitude of different connectors and adapters as well as the replacement of these due to wear and tear without affecting the life and integrity of the central housing.

20 Claims, 11 Drawing Sheets

MODULAR ROTATING DIVERTER HEAD

FIELD OF INVENTION

This invention relates to the field of fluid drilling equipment, and in particular to rotating diverter heads to be used in the field of fluid drilling equipment.

BACKGROUND OF INVENTION

In drilling a well, a drilling tool or "drill bit" is rotated under an axial load within a bore hole. The drill bit is attached to the bottom of a string of threadably connected tubulars or "drill pipe" located in the bore hole. The drill pipe is rotated at the surface of the well by an applied torque which is transferred by the drill pipe to the drill bit. As the bore hole is drilled, the hole bored by the drill bit is substantially greater than the diameter of the drill pipe. To assist in lubricating the drill bit, drilling fluid or gas is pumped down the drill pipe. The fluid jets out of the drill bit, flowing back up to the surface through the annulus between the wall of the bore hole and the drill pipe.

Conventional oilfield drilling typically uses hydrostatic pressure generated by the density of the drilling fluid or mud in the wellbore in addition to the pressure developed by pumping of the fluid to the borehole. However, some fluid reservoirs are considered economically undrillable with these conventional techniques. New and improved techniques, such as underbalanced drilling and managed pressure drilling, have been used successfully throughout the world. Managed pressure drilling is an adaptive drilling process used to more precisely control the annular pressure profile throughout the wellbore. The annular pressure profile is controlled in such a way that the well is either balanced at all times, or nearly balanced with low change in pressure. Underbalanced drilling is drilling with the hydrostatic head of the drilling fluid intentionally designed to be lower than the pressure of the formations being drilled. The hydrostatic head of the fluid may naturally be less than the formation pressure, or it can be induced.

Rotating diverter heads provide a means of sealing off the annulus around the drill pipe as the drill pipe rotates and translates axially down the well while including a side outlet through which the return drilling fluid is diverted. Such rotating diverter heads may also be referred to as rotating blow out preventers or drilling heads. These units generally comprise a stationary housing or bowl including a side outlet for connection to a fluid return line and an inlet flange for locating the unit on a blowout preventer or other drilling stack at the surface of the well bore. Within the bowl, opposite the inlet flange, is arranged a rotatable assembly such as anti-friction bearings which allow the drill pipe, located through the head, to rotate and slide. The assembly includes a seal onto the drill pipe which is typically made from rubber, polyurethane or other suitable elastomer.

Rotating diverter heads have usually been made from a single piece casting and in some cases with welded construction. This usually includes the side outlet flange as well as the inlet flange on the bottom as an integral part of the assembly. This type of design carries with it some penalties for operability, maintenance and also lifespan of the assembly. In terms of operability the fixed design of the lower inlet flange needs a crossover if the connection on the Annular BOP (Blow out Preventer) is of a different size or pressure rating, which increase the vertical height of the assembly which limits the usability. Prior art rotatable diverter heads such as those disclosed in U.S. Pat. No. 8,286,734 have tried to address this stack-up height issue. There are also issues in terms of horizontal angular orientation with prior art designs which both U.S. Pat. Nos. 8,286,734 and 7,308,954 have addressed with different solutions. Some of the solutions proposed in U.S. Pat. No. 8,286,734 suggest a non API (American Petroleum Institute) connection to the Annular BOP. Many customers have issues with such non-standard connectors when it is directly interfacing with their equipment.

All prior art designs have the side outlet as a single fixed size and pressure rating design which sometime also require crossovers and these can be problematic in terms of the additional lever arm they produce on the assembly when valves and piping are added to this flange.

In terms of usability, the current design principles result in different housings to accommodate different inlet/outlet sizes and pressure ratings, with sometimes as many as 4 housings required to accommodate the different client requirements. Furthermore when "washout" (erosional damage) occurs on the side outlet, often the whole housing has to be junked.

There exists the need for a single central master housing that can be easily adapted for a range of inlet/outlet sizes and pressure ratings, which can accommodate horizontal angular rotation when required. This central master housing design will also preserve the long term integrity of the newly developed rotating head system as will be described below.

SUMMARY OF INVENTION

A Modular Rotating Diverter Head that consist of a central housing, in the outline shape of a square cuboid, without any fixed inlet or outlet flanges or connectors. A system for attaching any required inlet size and pressure rating flange which allows for horizontal angular rotation and can minimize stack-up height. A system for attaching any required outlet size and pressure rating flange which incorporates features to preserve the central housing integrity during washout.

BRIEF DESCRIPTION OF DRAWINGS

For a more complete understanding of the present invention, and the advantages thereof, reference is now made to the following descriptions taken in conjunction with the accompanying drawings, in which.

DETAILED DESCRIPTION OF THE INVENTION

Figure 1A:
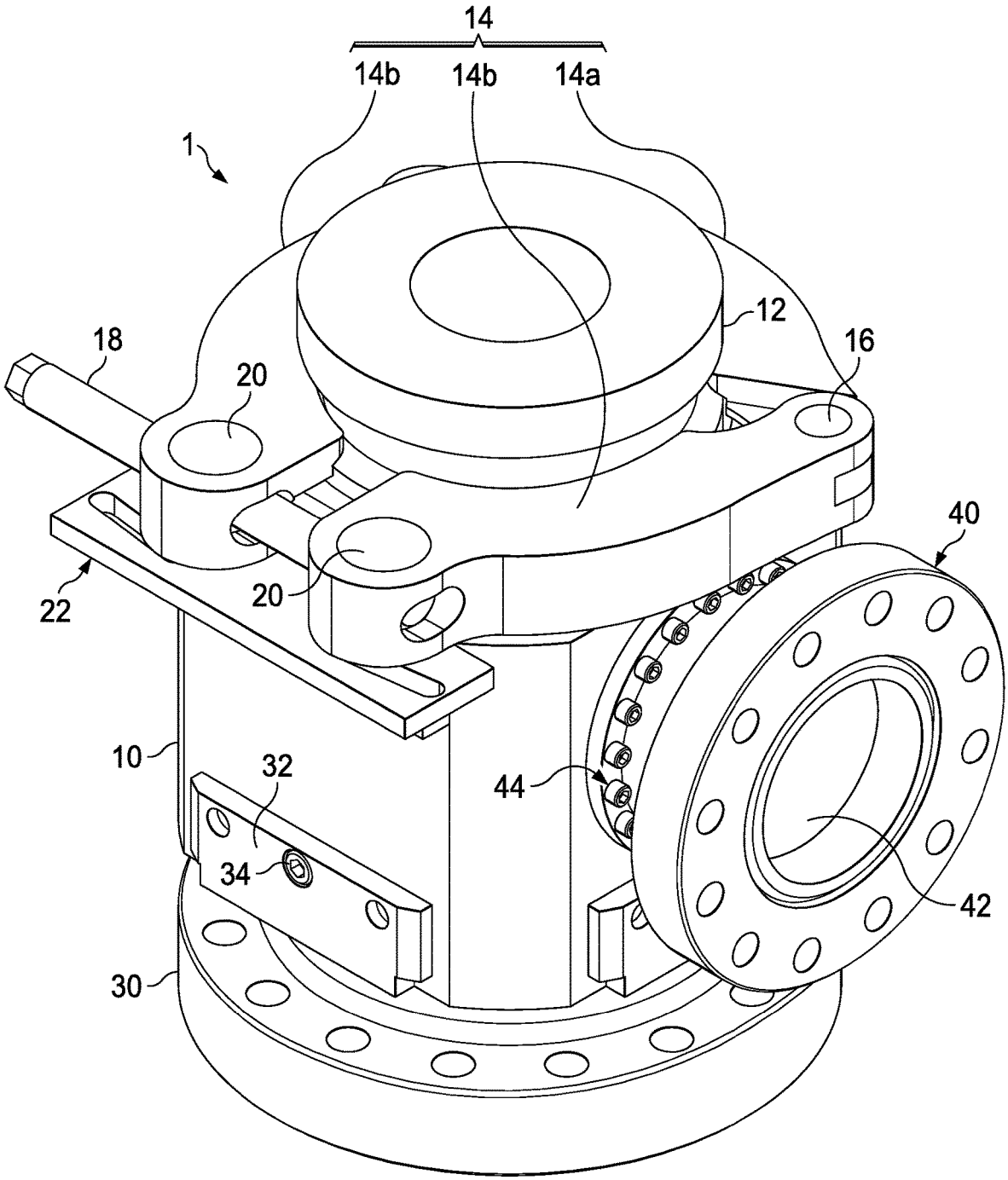
FIG. 1*a* shows an isometric view of a rotating diverter head according to an embodiment of the present application.

The principles of the present application and their advantages are best understood by referring to the illustrated embodiment depicted in FIGS. 1-5 of the drawings, in which like numbers designate like parts.

A new design for a Rotating Diverter Head is disclosed that makes use of modern forging technology to create a central block in the shape of a square cuboid with a cylindrical bore. From this core forged shape a housing is machined with no protruding appendages. This is different from conventional Rotating Head design where usually at least either the bottom flange or the side outlet flange is an integral part of the housing. Furthermore this design does not use an API (American Petroleum Institute) flange connection for any of the attached components allowing a compact and versatile design that is modular in the sense that custom appendages or flanges may be attached based on customer or job specific requirements.

This design has the further advantage of having the capability to replace such custom appendages or flanges due to wear, tear or repair requirements thus prolonging the lifespan of the central housing which is one of the more costly components of a rotating diverter head.

This modular design enables a variety of inlet flanges to be installed on the bottom of the housing to fit specific customer interfaces. This enables a reduction in housing inventories as the user does not have to carry multiple housings with customer specific flanges as in conventional designs. Furthermore, this design ensures that the customer interface bolting from the lower flange to the customer Blowout Preventer (BOP) is as per API standards for this connection. This design also enables a very low stack-up height of the rotating head assembly by enabling make-up of the central housing after lower flange installation to the customer BOP as the design allows the two components to be joined without requiring clearance for the bolt or nut make up of customer interface.

A further advantage of this modular design is that by removing the need for an API flange connection for the side outlet, an opportunity is created for a custom interface that allows inclusion of a wear sleeve for the outlet. The outlets on rotating heads are subjected to significant erosional and corrosional forces due to the fluid flow pattern driven by the geometry of a side outlet at 90 degrees to the inlet flow. This abrupt change in flow creates a fast erosion/corrosion environment that is strongest at the point of initial entry into the side bore. For conventional designs, this standard operating environment causes the loss of material in the wall of the side outlet as well as the main housing which eventually leads to the scrapping of the housing and/or side outlet. In the application disclosed the design enables the placement of a wear sleeve in the areas subjected to maximum erosion and corrosion. The wear sleeve is removable, allowing accurate assessment of the loss of material by measuring its thickness and/or inner diameter. If this material loss is outside of the limits of the design, the sleeve which is a comparatively cheap component to the main housing can be easily replaced.

For the clamp that is used to connect the central bearing assembly to the housing an updated design is disclosed which uses three parts as is now the common design for subsea clamps. This type of three part clamp allows smaller clearances and less opening travel requirement resulting in a more robust design compared to the single hinge, two part clamps in common use for conventional rotating heads. The clamp has an innovative guide pin mechanism which ensures equal opening or closing displacement of all three clamp segments in equal proportion. The drive mechanism disclosed is a rotational system but any time of mechanism capable of reciprocal displacement of the clamp drive ends like a pneumatic or hydraulic piston or other such solutions.

Further innovation is disclosed in the use of a split clamp for connection of the stripper rubber to the bearing assembly. This removes the need for bolts into the lower part of the bearing assembly which is a common failure point due to the possibility of over torque especially if the bearing fails. The connection has a novel feature in that it includes interlocking anti rotation lugs to prevent any slippage. The anti-rotation device includes metal protrusions locking into equivalent recesses disposed between the mating surfaces.

Accordingly, it is to be understood that the embodiments of the application herein described are merely illustrative of the application of the principles of the application. Reference herein to details of the illustrated embodiments is not intended to limit the scope of the claims, which themselves recite those features regarded as essential to the application.

Now referring to FIG. 1*a*, where a complete isometric drawing of the rotating diverter head 1 is disclosed. The illustration of the rotating diverter head 1 illustrated in FIGS. 1-5 are for illustration only. FIGS. 1-5 do not limit the scope of this disclosure to any particular embodiment of a rotating diverter head.

The rotating diverter head 1 includes a central housing 10, lower inlet flange 30, removable side outlet 40, a bearing assembly 12, and clamp assembly 14.

Showing the central housing 10 with removable lower inlet flange 30 and removable side flange or removable side outlet 40. The bearing assembly 12 is held in place with the clamp assembly 14.

Figure 1B:
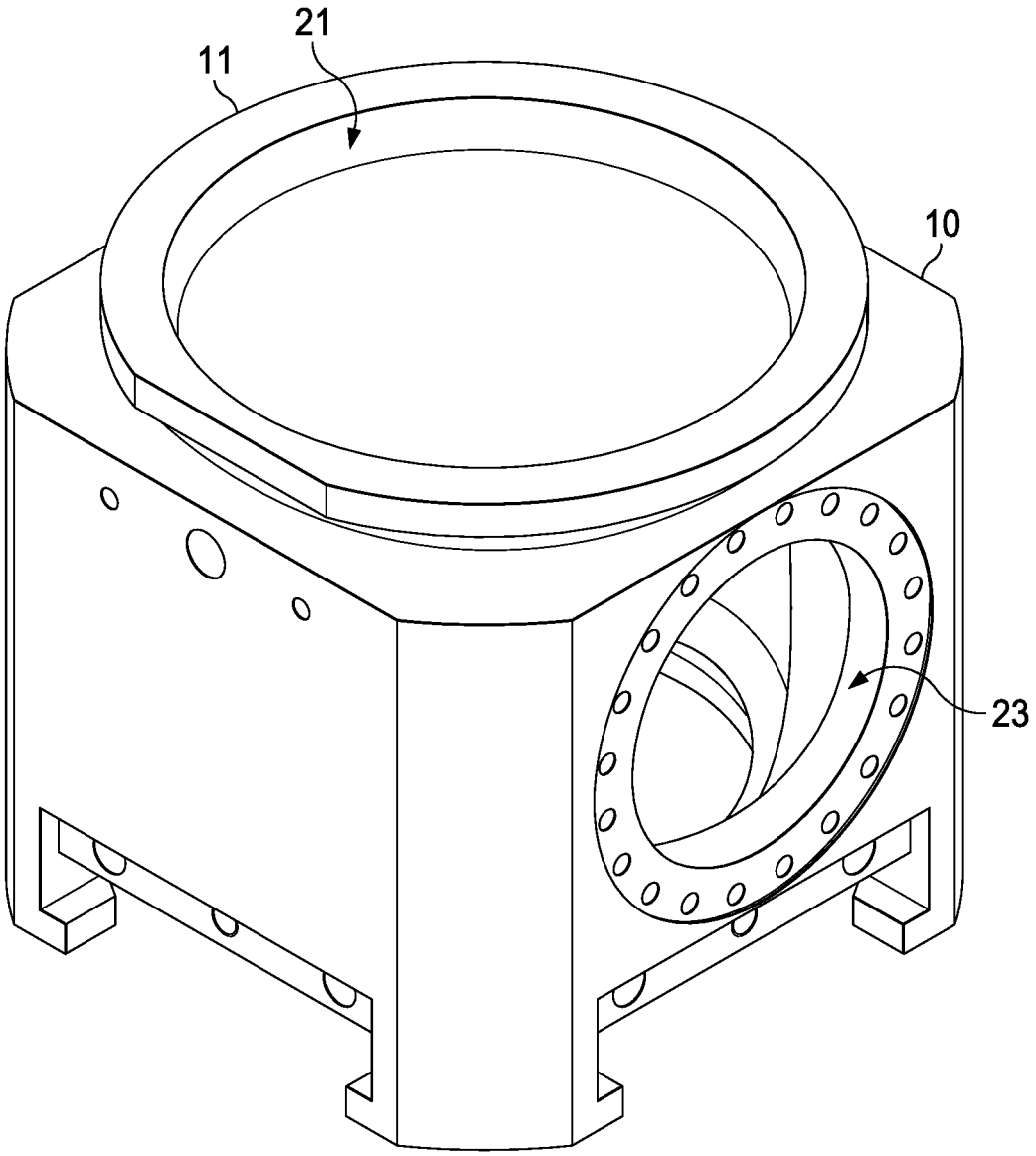
FIG. 1*b* shows an isometric view of the central housing only.
Figure 1D:
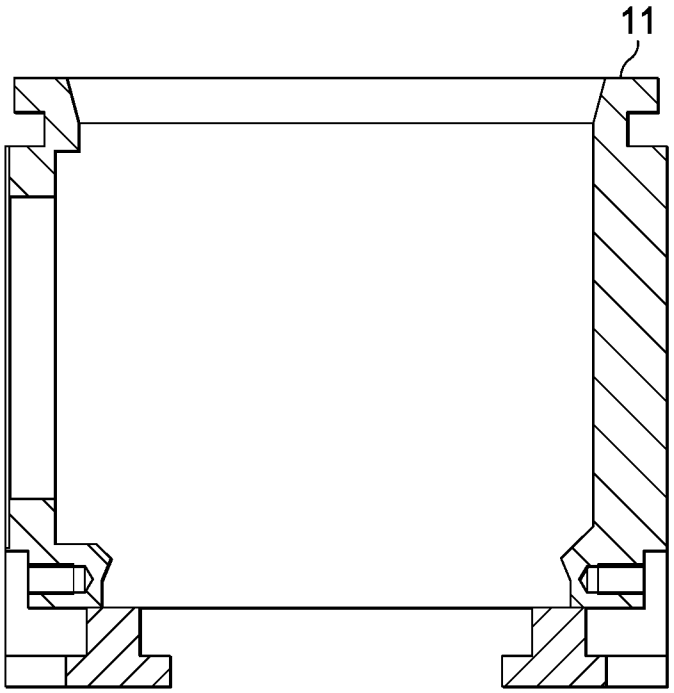
FIGS. 1*c* and 1*d* are respective end and side elevational views of the housing only.
Figure 1C:
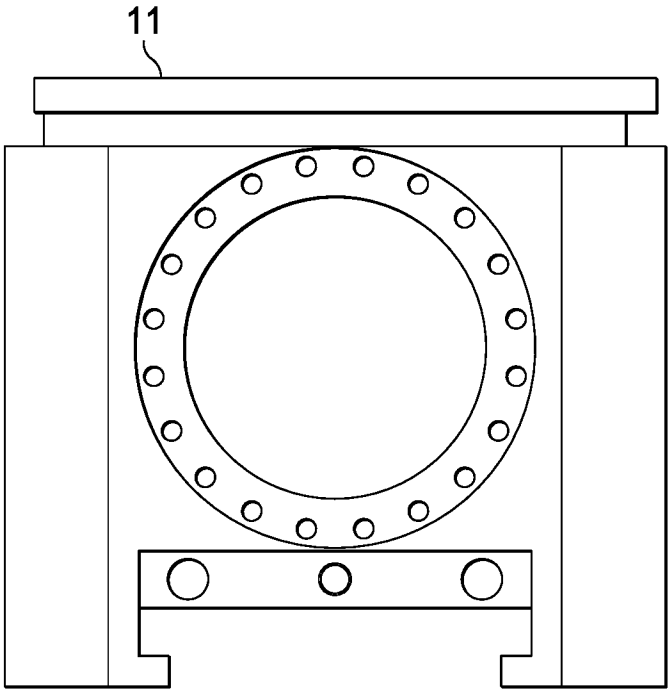

FIGS. 1*b*-1*d* show the central housing concept without any flanged protrusions on any of the sides or bottom. A hub connector protrusion 11 is disclosed at the top. This modular design allows a variety of inlet flange sizes and pressure ratings to be attached to the bottom. It allows a variety of inlet flange sizes and pressure ratings to be attached to the side outlet. It allows further side outlet orifices to be machined on the two free horizontally facing sides.

The central housing 10 includes a first cylindrical bore 21, a second cylindrical bore 23, and a hub connector protrusion 11. The first cylindrical bore 21 is aligned on a central axis of the central housing. The second cylindrical bore 23 located substantially transverse to the first cylindrical bore 21. The hub connector protrusion extends from a top of the central housing 10. The central housing 10 is without integral protrusions extending in a horizontal plane and a bottom of the central housing is without integral protrusions extending therefrom.

The central housing can further include a removable side outlet. The removable side outlet can have an outward facing flange of a selected pressure rating or sizing. A removable sleeve can be inserted into a bored of the at least one removable side outlet.

Figure 2A:
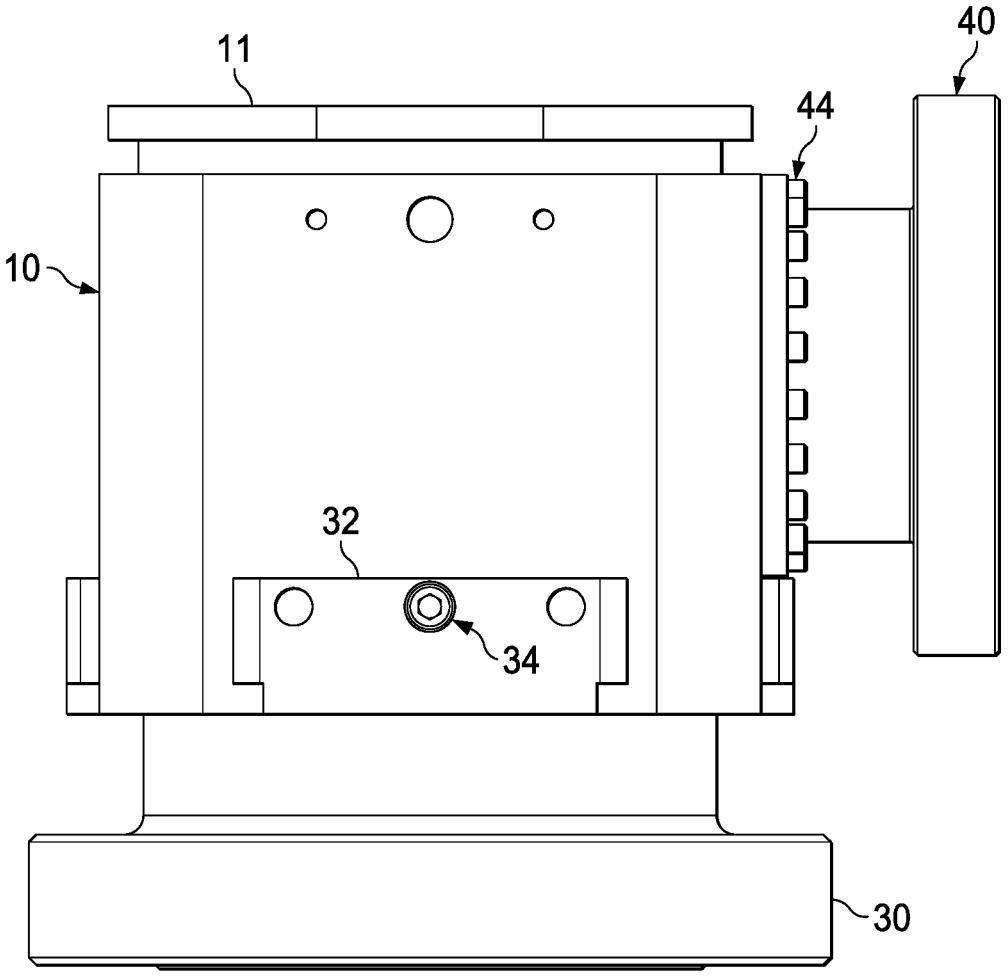
FIG. 2*a* shows side view of the application.
Figure 2B:
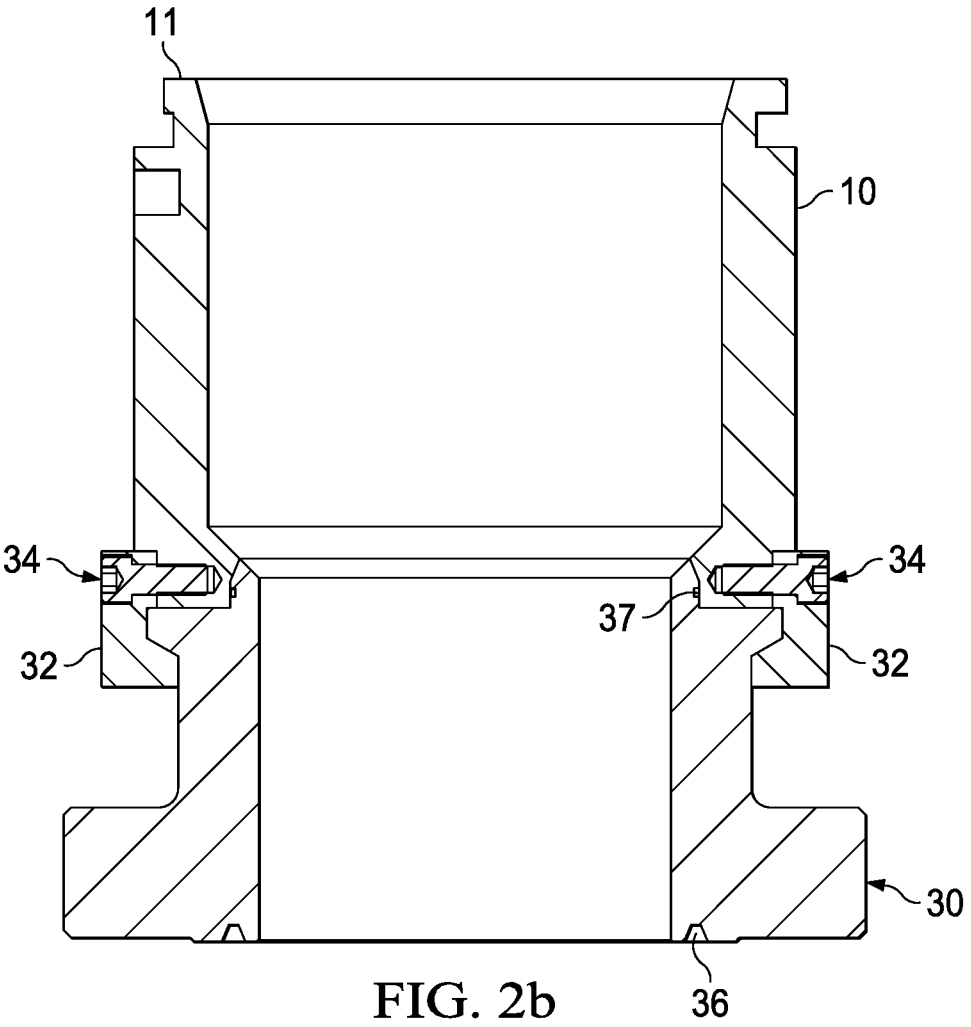
FIG. 2*b* shows a section at A-A so that the slide bowl concept can be seen.
Figure 2C:
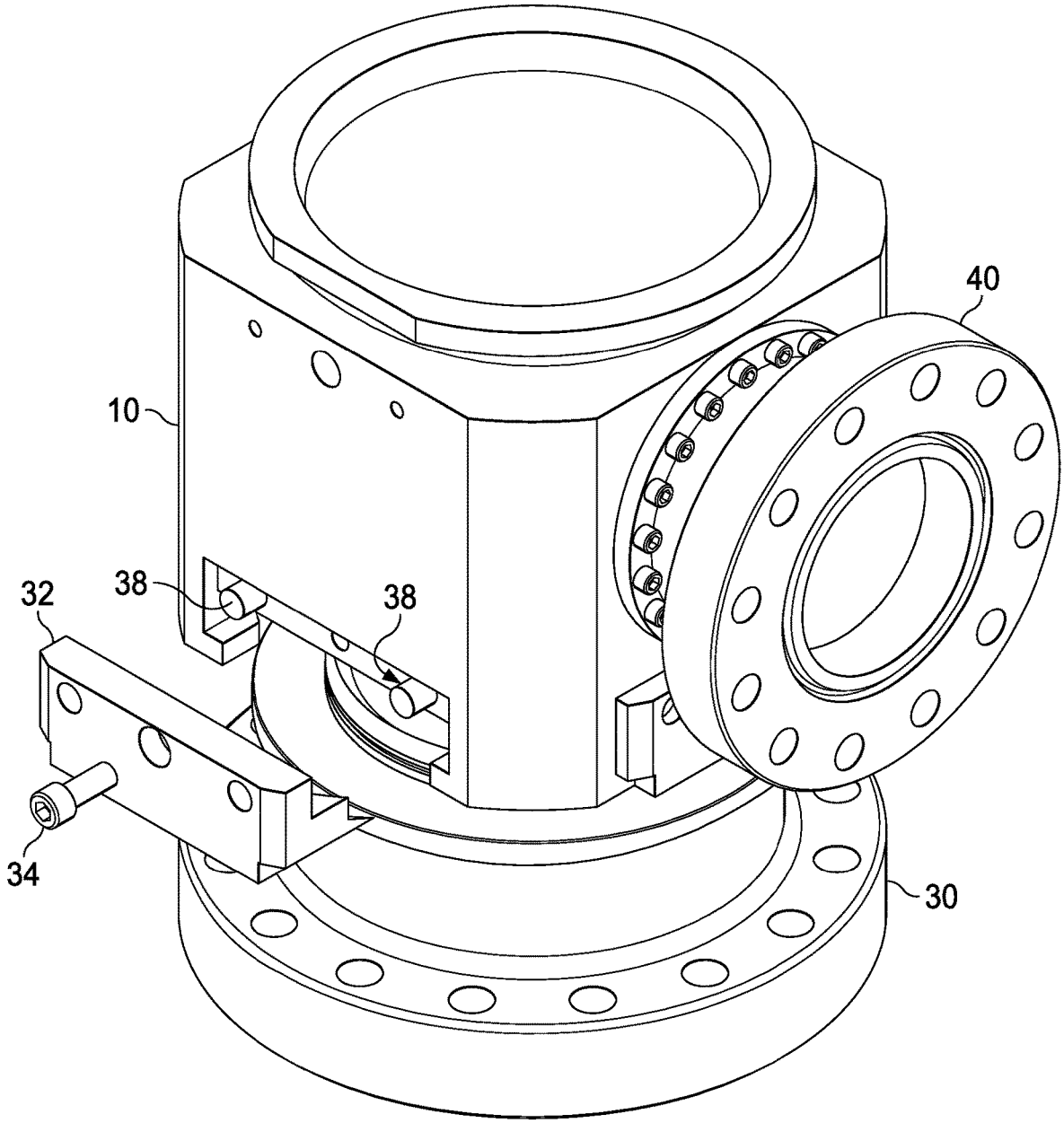
FIG. 2*c* shows an isometric exploded view to show the retention system for the slide bowl.

Referring to FIGS. 2*a*, 2*b* and 2*c*, the removable lower inlet flange 30 is disclosed which at the bottom is a standard API flange with ring groove 36 for the standard API metal seal ring (not shown) and at the top has a proprietary ring seal with groove 37. The removable lower inlet flange 30 is clamped in place by four equal clamps 32, one on each face that are held in place by bolts 34. The bolts 34 on the clamps 32 are supported by additional dowel pins 38.

The removable lower inlet flange 30 includes a locking mechanism for locking to the central housing, such as a wedge. The removable lower inlet flange 30 comprises a bottom end of a selected pressure rating or sizing. A space between the central housing 10 and a top face of the removable lower inlet flange 30 is adapted to minimally clear a height of a connection mechanism for connecting the removable lower inlet flange to a structure below. The removable lower inlet flange 30 is adapted to be bolted first to a corresponding third party connector before attachment to the main housing 10. The central housing 10 is adapted to be rotated axially Slide bowl concept: The central housing 10 is fixed to the removable lower inlet flange 30 by means of flange locks or clamps 32. The flange locks or clamps 32 fit into slots in the central housing 10, and engage the base flange or removable lower inlet flange 30 on an angled retention point, allowing for compression between the central housing 10 and base flange or the removable lower inlet flange 30. Dowel pins 38 strengthen the load bearing capability of the flange locks or clamps 32. The engagement between the central housing 10 and the base flange 30 may be sealed through any means on the circumference or groove 37, including but not limited to o-rings or API Ring Gaskets. This design allows the base flange or the removable lower inlet flange 30 to be attached to the BOP or stack before the central housing 10 is installed, allowing proper bolting of the base flange in applications which are height-restrictive, and permitting the central housing 10 to be placed in a lower position that otherwise possible. This also allows the central housing 10 to be rotated axially independently of the removable lower inlet flange 30 to properly align to existing flow lines, or other fixtures. Once alignment is achieved the clamps 32 are tightened with bolts 34 which will lock the two parts in position.

Figure 3A:
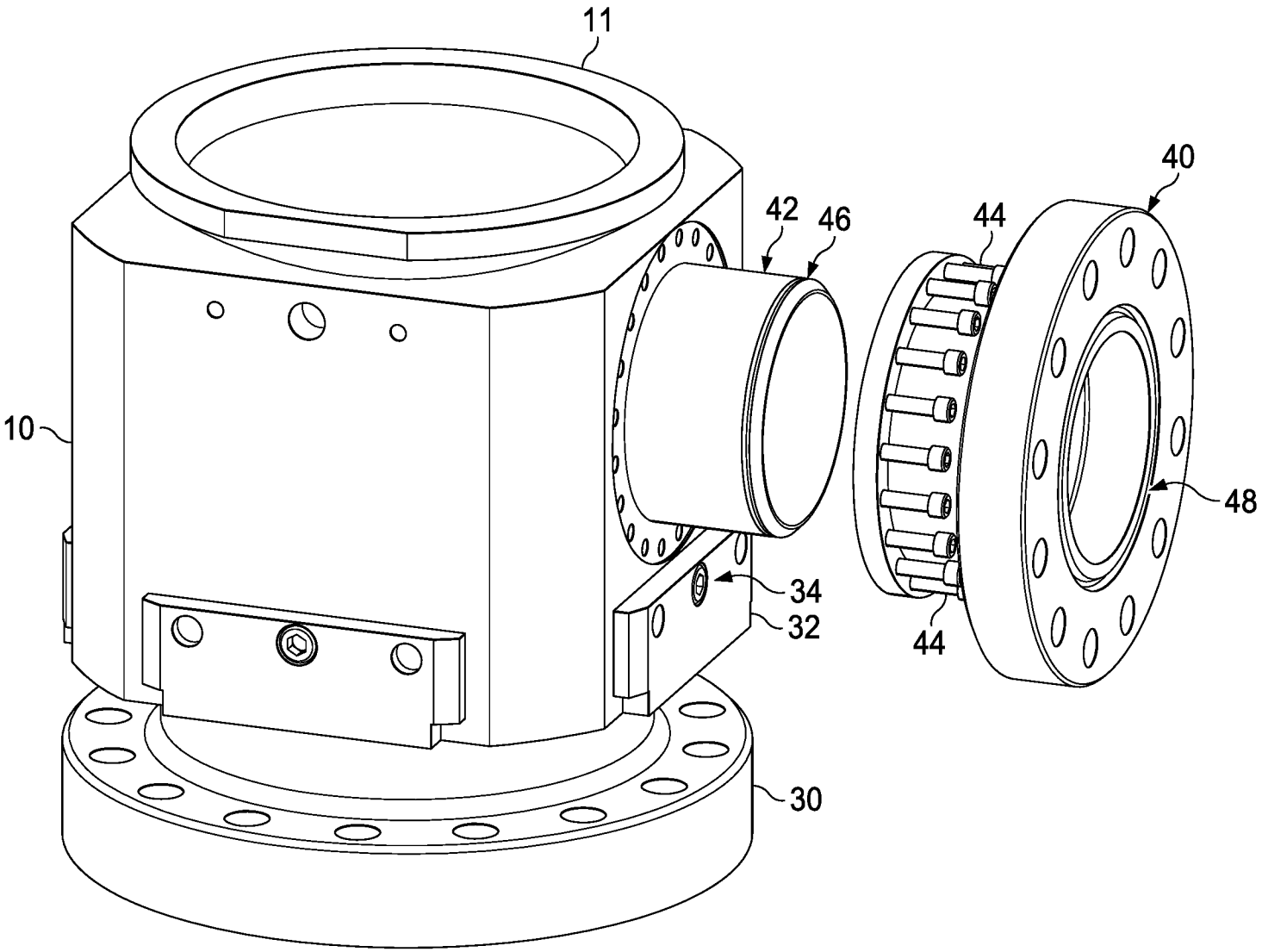
FIG. 3*a* shows an exploded isometric view of the application to illustrate the side flange outlet.
Figure 3B:
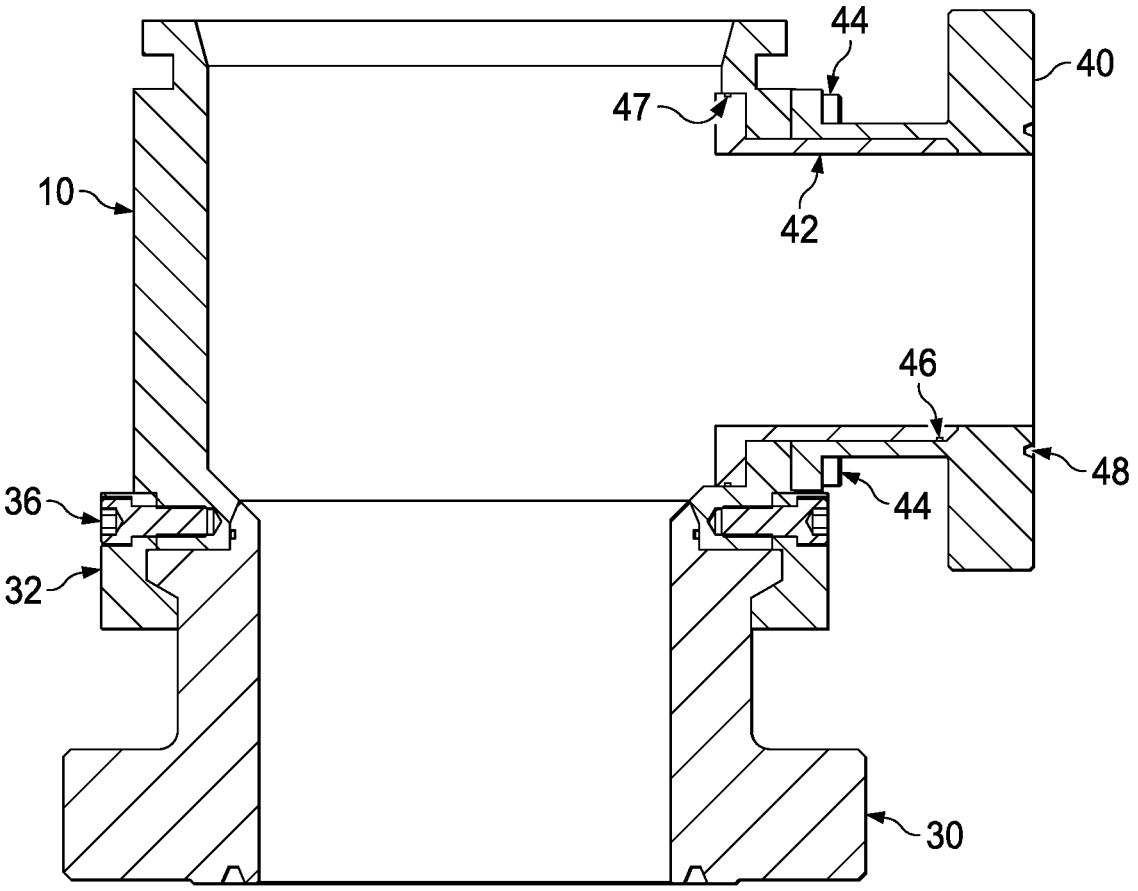
FIG. 3*b* shows a section view A-A of the side outlet flange to detail the removable wear sleeve.

Wear sleeve outlet concept: Referring now to FIGS. 3*a* and 3*b* a removable side outlet 40 is disclosed which may have an API ring groove 48 or other customer required seal and bolt interface. The outlet wear sleeve 42 is inserted from the main bore of the central housing 10. The side outlet flange or removable side outlet 40 then affixes to the outlet wear sleeve by bolting with bolts 44 through the central housing 10. The outlet wear sleeve 42 may be constructed from more durable materials to lessen the effects of wear or "wash-out" typically associated with air drilling, or other erosive situations in which the drilling medium contains excessive grit. The outlet wear sleeve 42 is sealed to the central housing 10 with an o-ring in a groove at item 47 as well as to the outlet flange with o-ring in a groove at item 46.

On FIG. 3*a*, the hub connector protrusion 11 which serves as the lower attachment point for clamp assembly 14 is disclosed.

Figure 4A:
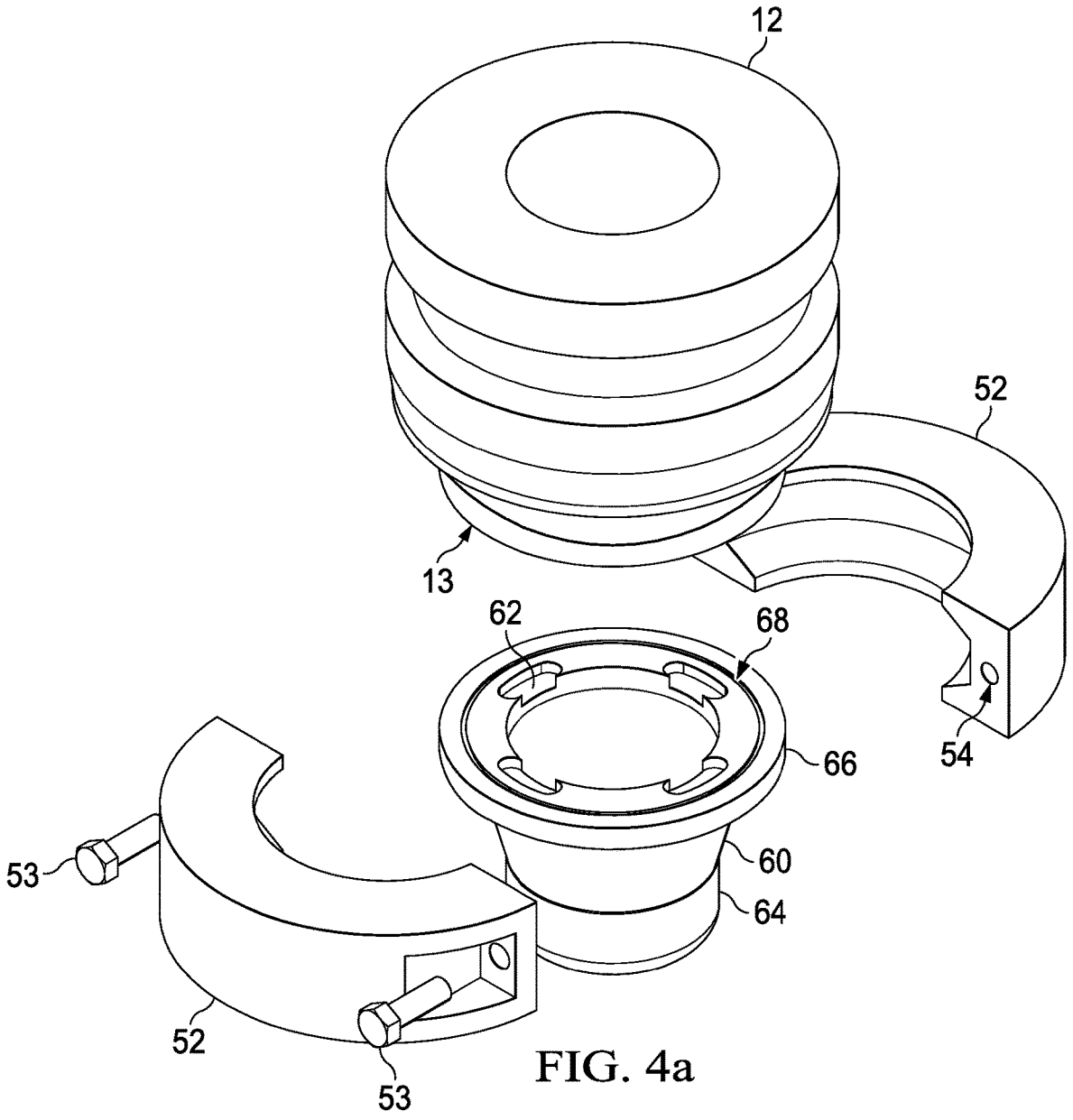
FIG. 4*a* shows an exploded isometric view of the connection system between bearing assembly and stripper rubber.
Figure 4B:
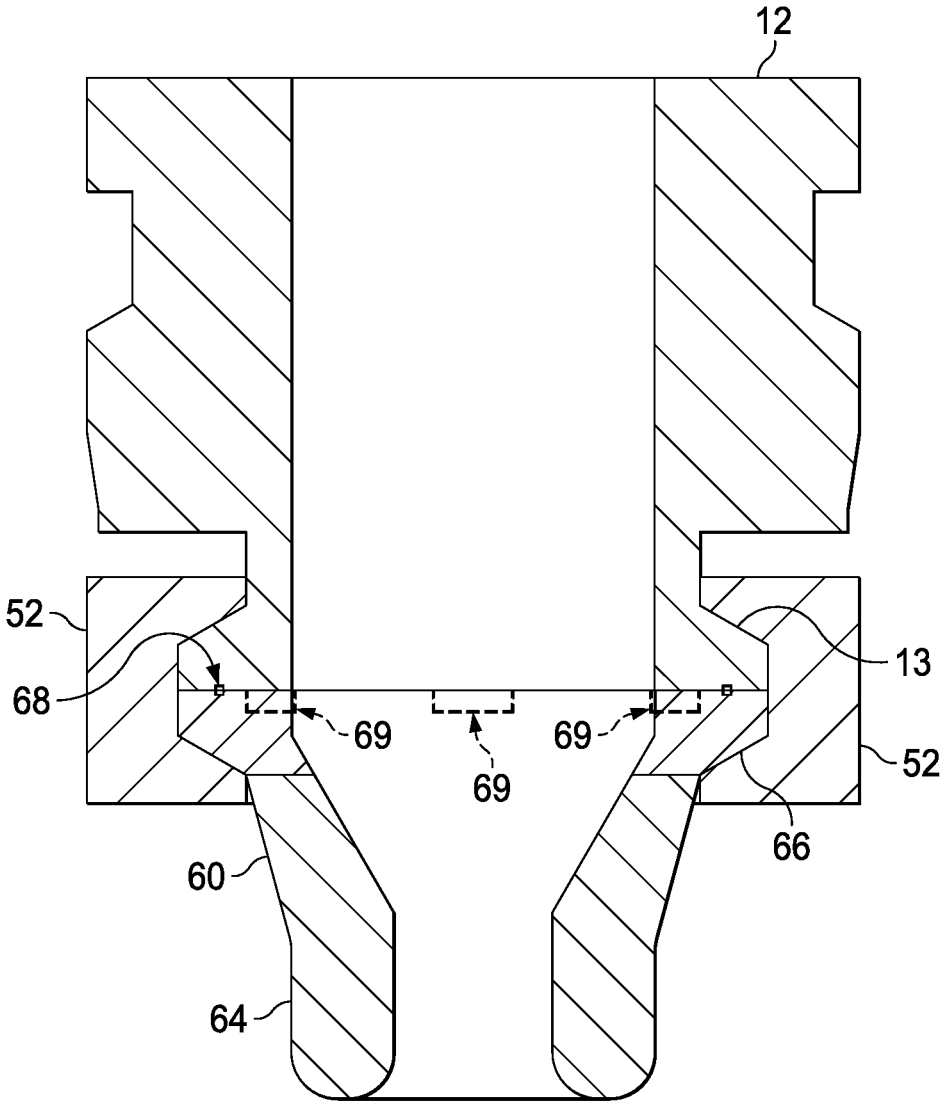
FIG. 4*b* shows a section view A-A of the connection system between bearing assembly and stripper rubber.

Lug drive assembly concept: Referring to FIGS. 4*a* and 4*b*, a clamp 52 consisting of two equal halves connects the lower hub 13 of the bearing assembly 12 to the upper steel hub part 66 of the stripper rubber assembly 60 which consists of the metal part or upper steel hub part 66 vulcanized to the rubber part 64. A seal is effected by the seal and seal groove 68. The clamp halves are bolted together by bolts 53 on one half of the clamp 52 tightened into the thread bore 54 of the other half of the clamp 52. Protruding lugs 69 are machined into lower hub 13 of the bearing assembly 12 and mating recesses 62 are machined into upper steel hub part 66 of stripper rubber assembly 60 which will prevent rotation between the two respective parts.

The bearing assembly 12 is located substantially within the central housing and includes a first rotational mechanism and a first sealing mechanism. The first rotational mechanism is for rotating the bearing assembly relative to the housing. The first sealing mechanism is for sealably engaging the bearing assembly upon a drill pipe when the drill pipe is inserted through the first cylindrical bore of the central housing 10.

Figure 5:
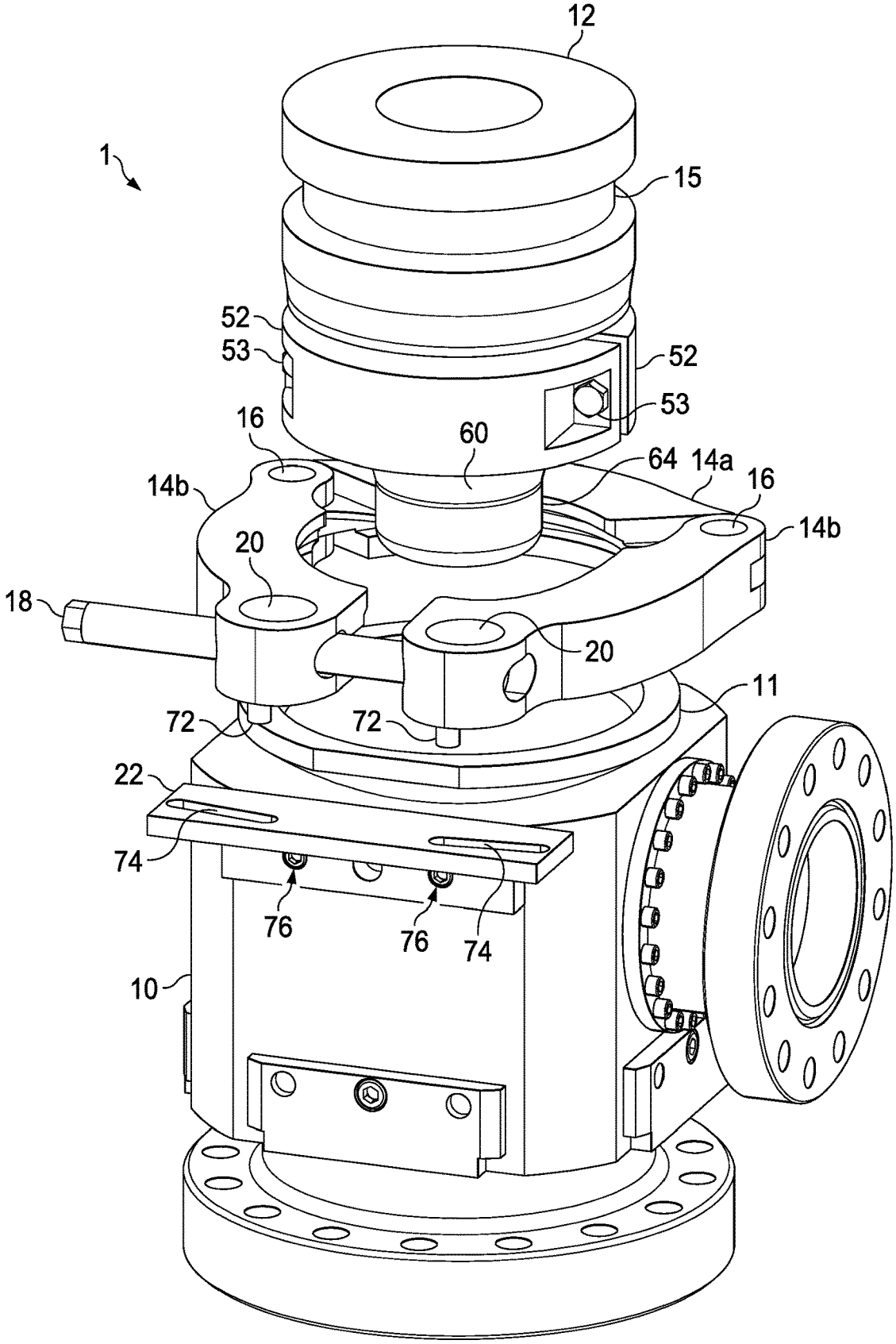
FIG. 5 shows an exploded view of the clamp mechanism to connect bearing assembly to main housing.

Clamp concept: Referring to FIGS. 1 and 5, a three part clamp assembly 14 is disclosed consisting of three clamps 14*a* and 14*b* held together by pins 16. The clamp assembly 14 can be opened and closed via the drive pins 20 that have opposing threads that are moved by rotating shaft 18. Other types of drive mechanism may be used that are capable of reciprocal displacement of the clamp drive ends like a pneumatic or hydraulic piston or other such solutions.

The outer two clamps 14*b* are connected by a closing and opening device, such as rotating shaft 18. The outer two clamps 14*b* are adapted for a main horizontal displacement by the closing and opening device to enable opening and closing of the outer clamps and clamping of the bearing assembly to the central housing 10. The opening and closing mechanism is adapted to force a concurrent horizontal displacement at ninety degrees to the main horizontal displacement.

The clamp opening displacement is controlled by pins 72 running in grooves 74 on the guide plate 22 that is bolted to central housing 10 by bolts 76. The grooves 74 are machined such that a concurrent displacement at 90 degrees to main displacement caused by shaft 18 occurs. This ensures that the furthest out clamps 14*b* on the opposite side to drive shaft 18 is displaced away from hub connector protrusion 11 on main housing 10 and hub 15 on bearing assembly 12. Although the application has been described with reference to specific embodiments, these descriptions are not meant to be construed in a limiting sense. Various modifications of the disclosed embodiments, as well as alternative embodiments of the application, will become apparent to persons skilled in the art upon reference to the description of the application. It should be appreciated by those skilled in the art that the conception and the specific embodiment disclosed might be readily utilized as a basis for modifying or designing other structures for carrying out the same purposes of the present application. It should also be realized by those skilled in the art that such equivalent constructions do not depart from the spirit and scope of the application as set forth in the appended claims.

It is therefore contemplated that the claims will cover any such modifications or embodiments that fall within the true scope of the application.

What is claimed is:

1. A rotating diverter head comprising:

a central housing including:

a first cylindrical bore aligned on a central axis of the central housing;

a plurality of sidewalls disposed around the central axis;

a second cylindrical bore located substantially transverse to the first cylindrical bore; and a hub connector extending from the central housing and having a bore aligned with the first cylindrical bore of the central housing;

a bearing assembly located at least partially disposed within the first cylindrical bore of the central housing and including a hub formed on the bearing assembly for rotatably connecting the bearing assembly to the housing;

a stripper rubber assembly connected to the bearing assembly to rotate with the bearing assembly for sealably engaging the bearing assembly upon a drill pipe when the drill pipe is inserted through the first cylindrical bore of the central housing;

a clamp assembly comprising two outer clamps hingedly connected to a central clamp disposed therebetween, wherein each of the two outer clamps and the central clamp is configured to couple a portion of the hub of the bearing assembly to a portion of the hub connector of the central housing and the two outer clamps and the central clamp collectively extend around a periphery of the bearing assembly for coupling the hub of the bearing assembly with the hub connector of the central housing;

wherein the two outer clamps are connected by a closing and opening device adapted to force concurrent displacement of the outer clamps to enable closing and opening of the outer clamps by operation of the closing and opening device for clamping and releasing of the bearing assembly to the central housing; and an inlet flange having a bore aligned with the central axis and removably coupled to the central housing by a plurality of clamps retained in slots through the plurality of sidewalls of the central housing; and further comprising a guide plate extending from a sidewall of the central housing, the clamp assembly including pins engaging slots in the guide plate.

2. The rotating diverter head as claimed in claim 1, further comprising at least one removable side outlet aligned with the second cylindrical bore of the central housing.

3. The rotating diverter head as claimed in claim 2, wherein the at least one removable side outlet includes an outward facing flange of a selected pressure rating or sizing.

4. The rotating diverter head as claimed in claim 2, further comprising a removable sleeve inserted into a bore of the at least one removable side outlet.

5. The rotating diverter head as claimed in claim 1, further comprising a stripper rubber assembly clamp for connecting the stripper rubber assembly to the bearing assembly.

6. The rotating diverter head as claimed in claim 5, wherein the stripper rubber assembly clamp comprises two parts.

7. The rotating diverter head as claimed in claim 6, wherein mating surfaces of the stripper rubber assembly and the bearing assembly include an anti-rotation device.

8. The rotating diverter head as claimed in claim 7, wherein the anti-rotation device includes metal protrusions locking into equivalent recesses disposed between the mating surfaces.

9. The rotating diverter head as claimed in claim 1, wherein the action of the pins of the clamp assembly engaging the slots of the guide plate produces equal opening and closing displacements of the center clamp and the two outer clamps.

10. The rotating diverter head as claimed in claim 1, wherein the closing and opening device forces the concurrent displacement of the outer clamps upon rotation of a single shaft.

11. The rotating diverter head as claimed in claim 1, wherein the closing and opening device produces reciprocal displacement of ends of the outer clamps.

12. A rotating diverter head comprising:

a central housing including:

a first cylindrical bore aligned on a central axis of the central housing;

a plurality of sidewalls disposed around the central axis;

a second cylindrical bore located substantially transverse to the first cylindrical bore; and a hub connector extending from the central housing and having a bore aligned with the first cylindrical bore of the central housing;

a bearing assembly located at least partially disposed within the first cylindrical bore of the central housing and including a hub formed on the bearing assembly for rotatably connecting the bearing assembly to the housing;

a stripper rubber assembly connected to the bearing assembly to rotate with the bearing assembly for sealably engaging the bearing assembly upon a drill pipe when the drill pipe is inserted through the first cylindrical bore of the central housing;

a clamp assembly comprising two outer clamps hingedly connected to a central clamp disposed therebetween, wherein each of the two outer clamps and the central clamp is configured to couple a portion of the hub of the bearing assembly to a portion of the hub connector of the central housing and the two outer clamps and the central clamp collectively extend around a periphery of the bearing assembly for coupling the hub of the bearing assembly with the hub connector of the central housing;

wherein the two outer clamps are connected by a closing and opening device adapted to force concurrent displacement of the outer clamps to enable closing and opening of the outer clamps by operation of the closing and opening device for clamping and releasing of the bearing assembly to the central housing; and an inlet flange having a bore aligned with the central axis and removably coupled to the central housing by a plurality of clamps retained in slots through the plurality of sidewalls of the central housing;

wherein the closing and opening device forces the concurrent displacement of the outer clamps upon rotation of a single shaft; and wherein the closing and opening device further comprises a drive pin disposed in each of the two outer clamps;

the respective drive pins have opposing threads, and the single shaft extends between the respective drive pins to concurrently move the pins when the shaft is rotated.

13. The rotating diverter head as claimed in claim 12, further comprising at least one removable side outlet aligned with the second cylindrical bore of the central housing.

14. The rotating diverter head as claimed in claim 13, wherein the at least one removable side outlet includes an outward facing flange of a selected pressure rating or sizing.

15. The rotating diverter head as claimed in claim 13, further comprising a removable sleeve inserted into a bore of the at least one removable side outlet.

16. The rotating diverter head as claimed in claim 12, further comprising a stripper rubber assembly clamp for connecting the stripper rubber assembly to the bearing assembly.

17. The rotating diverter head as claimed in claim 16, wherein the stripper rubber assembly clamp comprises two parts.

18. The rotating diverter head as claimed in claim 17, wherein mating surfaces of the stripper rubber assembly and the bearing assembly include an anti-rotation device.

19. The rotating diverter head as claimed in claim 12, further comprising:

a guide plate extending from a sidewall of the central housing, the clamp assembly including pins engaging slots in the guide plate, and wherein the action of the pins of the clamp assembly engaging the slots of the guide plate produces equal opening and closing displacements of the center clamp and the two outer clamps.

20. The rotating diverter head as claimed in claim 12, wherein the closing and opening device produces reciprocal displacement of ends of the outer clamps.

* * * * *